US006854977B2

(12) United States Patent
DuRocher et al.

(10) Patent No.: US 6,854,977 B2
(45) Date of Patent: Feb. 15, 2005

(54) STEERING WHEEL ROTARY CONNECTOR

(75) Inventors: Daniel J. DuRocher, Leonard, MI (US); Stephen J. Horner, Fenton, MI (US); Kevin P. Jokipii, Center Line, MI (US)

(73) Assignee: TRW Inc., Lyndhurst, OH (US)

( * ) Notice: Subject to any disclaimer, the term of this patent is extended or adjusted under 35 U.S.C. 154(b) by 2 days.

(21) Appl. No.: 10/242,814

(22) Filed: Sep. 13, 2002

(65) Prior Publication Data

US 2004/0053517 A1 Mar. 18, 2004

(51) Int. Cl.[7] ..... H01R 35/04
(52) U.S. Cl. ..... 439/15; 439/164; 280/728.2
(58) Field of Search ..... 439/15, 16, 164; 280/728.2

(56) References Cited

U.S. PATENT DOCUMENTS

| | | | | |
|---|---|---|---|---|
| 5,151,042 A | | 9/1992 | Okada | |
| 5,226,830 A | | 7/1993 | Ueno | |
| 5,246,377 A | | 9/1993 | Kawahara et al. | |
| 5,593,310 A | | 1/1997 | Kawamoto et al. | 439/164 |
| 5,704,633 A | | 1/1998 | Durrani et al. | 280/728.2 |
| 5,752,843 A | | 5/1998 | Kawamoto et al. | 439/164 |
| 5,884,936 A | | 3/1999 | Matsu et al. | 280/728.2 |
| 5,993,228 A | | 11/1999 | Kubota | 439/164 |
| 6,341,969 B1 | * | 1/2002 | Taniuchi et al. | 439/164 |
| 6,343,946 B1 | * | 2/2002 | Matsumoto | 439/164 |
| 6,390,838 B1 | * | 5/2002 | Kawamura | 439/164 |
| 6,471,529 B2 | * | 10/2002 | Oishi | 439/164 |

FOREIGN PATENT DOCUMENTS

| | | |
|---|---|---|
| EP | 0853355 | 3/1999 |
| GB | 2291281 | 1/1996 |
| GB | 2301232 | 11/1996 |

* cited by examiner

*Primary Examiner*—Dean A. Reichard
*Assistant Examiner*—Adolfo Nino
(74) *Attorney, Agent, or Firm*—Tarolli, Sundheim, Covell & Tummino L.L.P.

(57) ABSTRACT

Apparatus (10) includes a vehicle steering wheel (14), a device (220) mountable on the steering wheel, a rear cover (60) that at least partially covers the steering wheel, a rotary connector (100) including a housing (110) for providing an electrical connection with the device. A first electrical connector (210) includes a first connector piece (212) and a second connector piece (214). The first connector piece (212), housing (110) and rear cover (60) are molded as a single piece of plastic material. The second connector piece (214) is guided to interconnect with the first connector piece (212) when the device (220) is installed on the steering wheel (14). The first and second connector pieces (212 and 214) when interconnected provide, an electrical connection between the device (220) and a cable (150) of the rotary connector (100).

14 Claims, 5 Drawing Sheets

STEERING WHEEL ROTARY CONNECTOR

FIELD OF THE INVENTION

The present invention relates to a rotary connector for providing an electrical connection from components mounted on a vehicle steering wheel to a fixed portion of the vehicle, such as a steering column.

BACKGROUND OF THE INVENTION

In the automotive industry, it is desirable to provide an electrical connection between components mounted on a vehicle steering wheel and fixed portions of the vehicle, such as a steering column of the vehicle. For example, steering wheel mounted air bags and steering wheel mounted controls for devices such as an audio system, climate control system, cruise control, communications devices, and horns may require an electrical connection from the steering wheel to associated devices and/or the vehicle electrical system. These electrical connections are typically provided via a rotary connector that provides an electrical connection between the steering wheel and the fixed or non-rotating portion of the steering column.

There are a variety of known rotary connector configurations. In one configuration, a flat flexible cable and a spacer are disposed between first and second housing parts. The first and second housing parts and the spacer are rotatable relative to each other about an axis. The first housing part comprises a rotor connected to and rotatable with the steering wheel and the second housing part comprises a stator fixed to a stationary part of the vehicle, such as the steering column.

The flat flexible cable has a first coiled portion positioned between the spacer and the first housing part and a second coiled portion positioned between the spacer and the second housing part. The first and second coiled portions are wound in opposite directions. A portion of the flat flexible cable extends through an opening in the spacer between the first and second coiled portions.

As the vehicle steering wheel turns, the first housing portion and the spacer rotate relative to the second housing portion. When the steering wheel turns in a first rotational direction, the flat flexible cable is unwound from the first coiled portion and wound onto the second coiled portion. When the steering wheel turns in a second rotational direction, opposite the first rotational direction, the flat flexible cable is unwound from the second coiled portion and wound onto the first coiled portion. The flat flexible cable passes through the opening in the spacer as it is unwound from and wound onto the first and second coiled portions.

SUMMARY OF THE INVENTION

An apparatus comprises a vehicle steering wheel, a device mountable on the steering wheel, a rear cover that at least partially covers the steering wheel, and a rotary connector for providing an electrical connection with the device. The rotary connector includes a housing that forms a part of the rear cover. A base is connected to the housing, the housing and the base being rotatable relative to each other about an axis. A cable is coiled in an annular space defined by the housing and the base.

A first electrical connector includes a first connector piece including portions electrically connected to a first end of the cable and a second connector piece including portions electrically connected to the device. The first connector piece, housing and rear cover are molded as a single piece of plastic material. A first guide guides the device toward the predetermined position on the steering wheel. The second connector piece is guided to interconnect with the first connector piece when the device is guided to the predetermined position. The first and second connector pieces when interconnected provide an electrical connection between the device and the cable.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DESCRIPTION OF THE PREFERRED EMBODIMENTS

Figure 1:
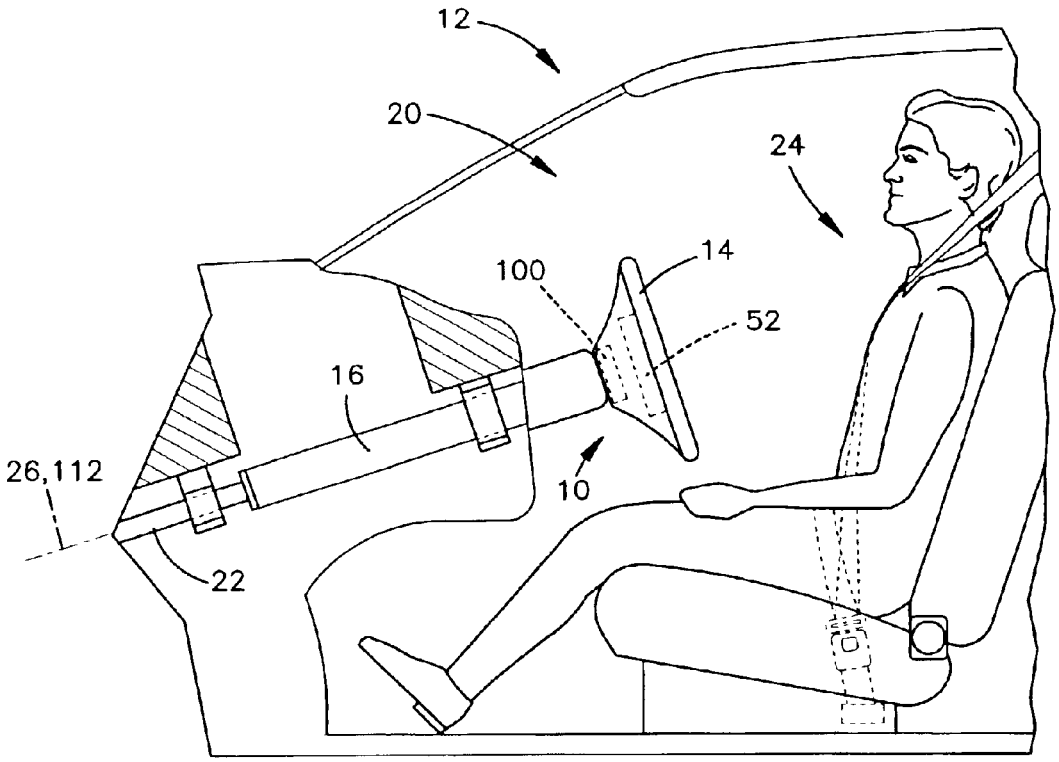
FIG. 1 is a schematic view of an apparatus mounted in a vehicle in accordance with the present invention.

As representative of the present invention, FIG. 1 illustrates an apparatus 10 in an installed position in a vehicle 12. The vehicle 12 includes a steering wheel 14 mounted on a steering column 16 of the vehicle. The steering wheel 14 is located in an occupant compartment 20 of the vehicle 12 and is connected to a steering shaft 22 that extends through the steering column 16. A vehicle occupant 24 may rotate the steering wheel 14 and steering shaft 22 about a steering axis 26 to effect steering movement of the vehicle 10 in a known manner.

Figure 2:
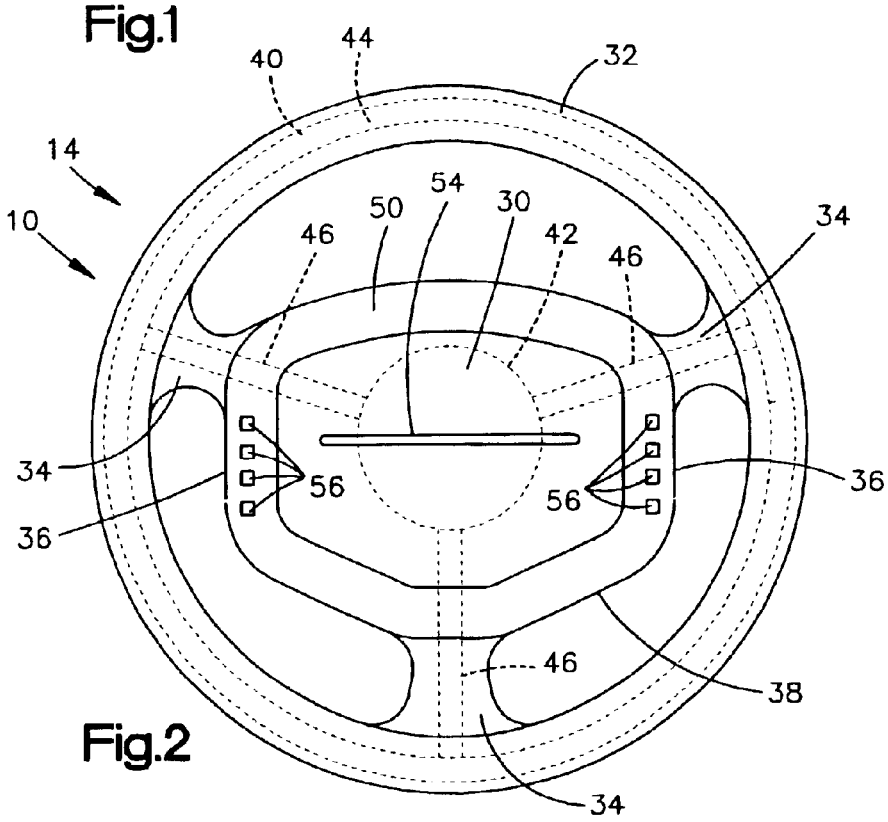
FIG. 2 is a schematic front view of a portion of the apparatus of FIG. 1.
Figure 3:
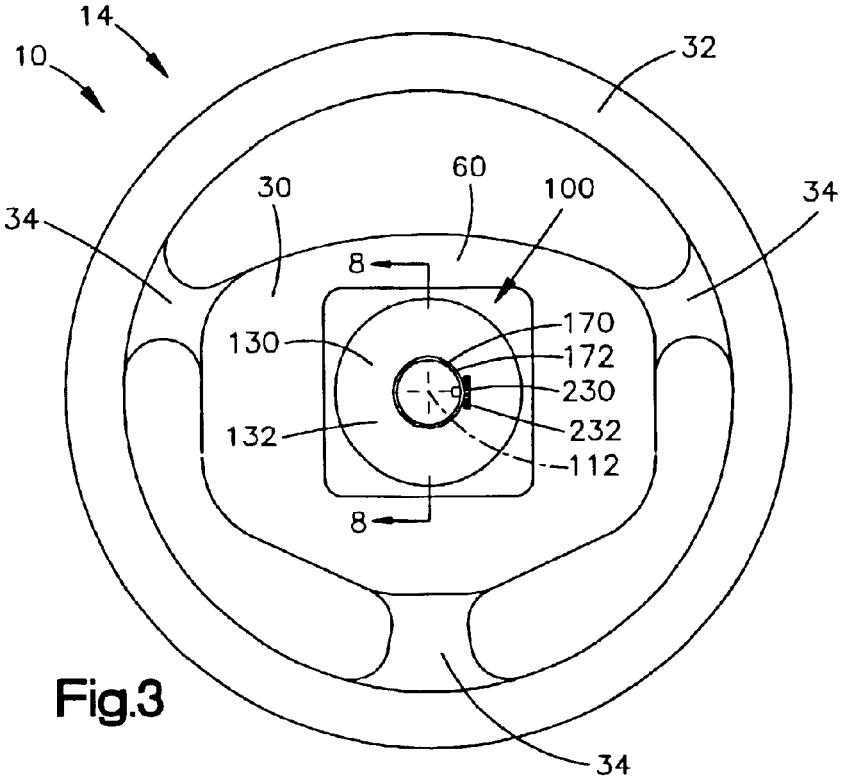
FIG. 3 is a schematic rear view of a portion of the apparatus of FIG. 1.
Figure 4:
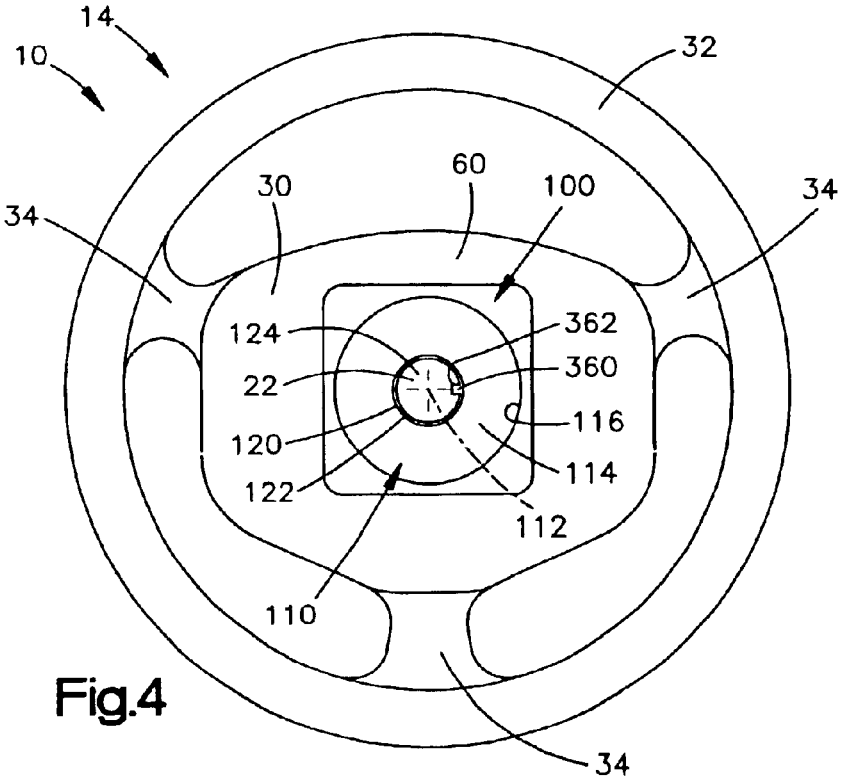
FIG. 4 is a schematic rear view of a portion of the apparatus of FIG. 1 with certain parts removed.

Referring to FIGS. 2–4, the steering wheel 14 includes a hub 30, a rim 32, and a plurality of spokes 34 extending from the hub to the rim. The steering wheel 14 comprises an armature 40 (see FIG. 2) including a hub portion 42, a rim portion 44 and spoke portions 46 connecting the rim portion to the hub portion. The armature 40 is at least partially coated or otherwise covered with a plastic material, such as urethane. As shown in FIG. 2, the steering wheel 14 may include a front cover 50 for concealing a safety device such as an air bag 52 (see FIG. 1). The front cover 50 may include a tear seam 54 along which the front cover ruptures when the air bag is inflated.

The steering wheel 14 may also include control switches, illustrated schematically at 56, for controlling devices such as an audio system, climate control system, cruise control, communications devices, and horn. In the illustrated embodiment, the switches 56 are positioned on or extending through the front cover 50 along opposite lateral edges 36 of the hub 30. It will be appreciated, however, that the switches 56 could have alternative positions on the steering wheel 14. For example, the switches 56 could be positioned along a lower edge 38 of the hub 30. As another example, the switches 56 could be included in a module (not shown) connected to the steering wheel 14 at a location such as between the hub 30 and the rim 32.

Referring to FIGS. 3 and 4, the steering wheel 14 also includes a rear cover 60 detachably connected to the steering wheel and/or the armature 30. The rear cover 60 includes at least one portion forming a surface visible from within an occupant compartment of the vehicle 12. These surfaces are sometimes referred to as class A surfaces. The rear cover 60 thus serves as a styled trim piece that provides an attractive appearance for the rear portion of the steering wheel 14.

According to the present invention, the apparatus 10 comprises a rotary connector 100 having a portion formed integrally with the rear cover 60 of the steering wheel 14. The rotary connector 100 provides an electrical connection between steering wheel 14 and the fixed portion of the steering column 16. In the illustrated embodiment, the rotary connector 100 provides an electrical connection from the steering column 16 to the air bag 52 and/or the control switches 56.

Figure 5:
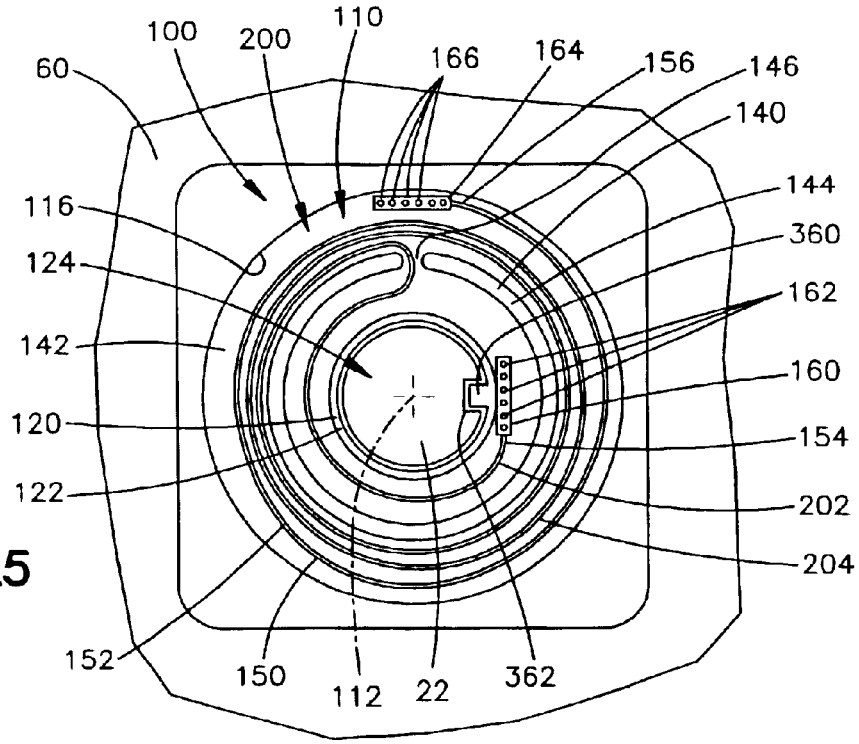
FIG. 5 is a magnified schematic view of a portion of the apparatus of FIG. 1.
Figure 6:
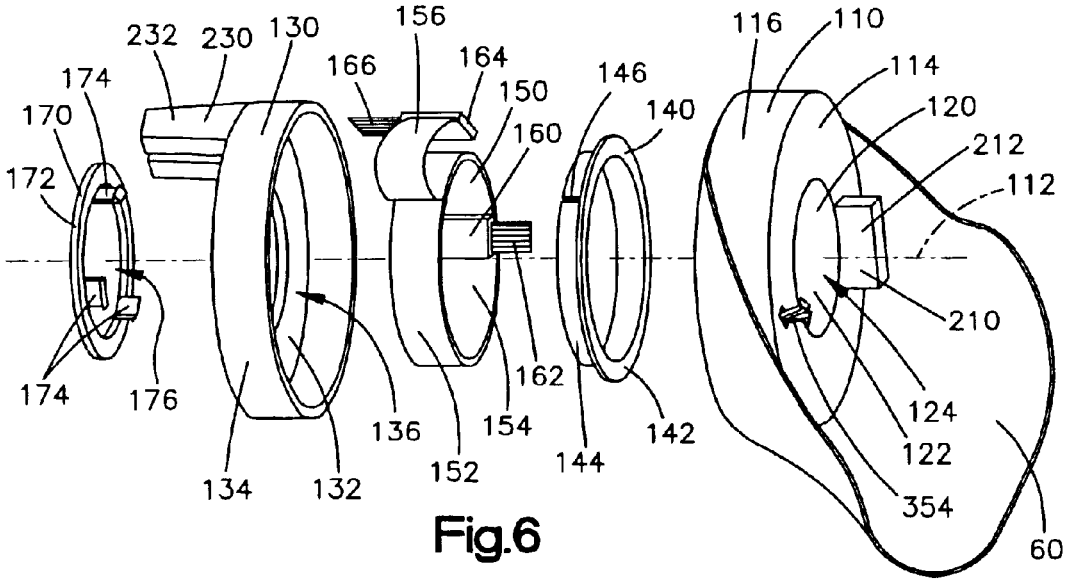
FIG. 6 is an exploded perspective view of a portion of the apparatus of FIG. 1.

As best shown in FIG. 6, in the illustrated embodiment, the rotary connector 100 includes a housing 110, a base 130, a fold back hoop 140, a flat flexible cable 150, and a retainer clip 170. The housing 110 is molded integrally with the rear cover 60 of the steering wheel 14. Referring to FIGS. 4–6 and 8, the housing 110 has a generally cylindrical configuration centered on an axis 112. The housing 110 includes a base wall 114 that extends radially from the axis 112 and a cylindrical side wall 116 that extends perpendicularly from the base wall 114. The housing 110 also includes a cylindrical hub portion 120 centered on the axis 112 and including a side wall 122 that extends parallel to the side wall 116. The hub portion 120 defines a cylindrical central passage 124 that extends through the housing 110 and the rear cover 60.

Referring to FIGS. 4–6 and 8, the base 130 has a generally cylindrical configuration centered on the axis 112 (i.e., when the rotary connector 100 is in the assembled condition). The base 130 includes a radially extending top wall 132 centered on the axis 112 and a cylindrical side wall 134 that extends perpendicularly from a periphery of the top wall. The base 130 also includes a generally circular central opening 136 that is centered on the axis 112 and extends through the top wall 132.

Figure 8:
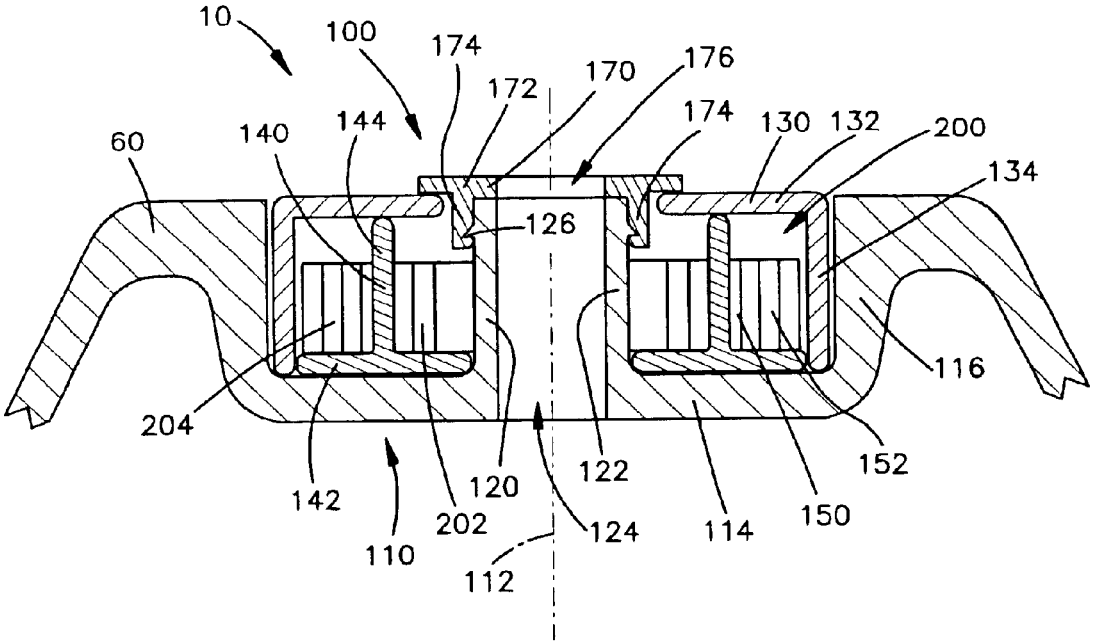
FIG. 8 is a sectional view taken generally along line 8—8 in FIG. 3.

Referring to FIGS. 5, 6, and 8, the fold back hoop 140 comprises an annular base portion 142 centered on the axis 112 (i.e., when the rotary connector 100 is in the assembled condition). The fold back hoop 140 also includes a wall portion 144 that extends perpendicularly from the base portion 142. The wall portion 144 extends almost all of the way around the circumference of the base portion 142, leaving a slot or opening 146 between opposite ends of the wall portion.

The flat flexible cable 150 comprises a cable portion 152 having a flat configuration and constructed so as to exhibit a flexible quality. The cable portion 152 includes a plurality of conductors (not shown) at least partially surrounded by an insulating material. The cable portion 152 has a first end 154 and an opposite second end 156. The first end 154 is fit with a first terminal assembly 160 that includes a plurality of terminals 162, each of which may be electrically connected with at least one of the conductors of the cable portion 152. The second end 156 is fit with a second terminal assembly 164 that includes a plurality of terminals 166, each of which may be electrically connected with at least one of the conductors of the cable portion 152.

Referring to FIGS. 3, 6, and 8, the retainer clip 170 comprises an annular base portion 172 centered on the axis 112 (i.e., when the rotary connector 100 is in the assembled condition). The retainer clip 170 also includes at least one latch member 174 that extends perpendicularly from the base portion 172. The retainer clip 170 also includes a generally circular central opening 176 that is centered on the axis 112 and extends through the base portion 172.

Referring to FIGS. 5 and 8, when the rotary connector 100 is in the assembled condition, the fold back hoop 170 and the flat flexible cable 150 are disposed in an annular space 200 defined between the housing 110 and the base 130. More particularly, the annular space 200 is defined, as viewed in FIG. 8, at a lower extent by the base wall 114, at an outer extent by the side wall 116 and/or wall portion 134, at an inner extent by the side wall 122, and at an upper extent by the top wall 132.

The retainer clip 170 retains the housing 110, base 130, fold back hoop 140, and flat flexible cable 150 in the assembled condition. The latch members 174 of the retainer clip 170 abut an outer surface of the hub 120 and engage an annular latching rim 126 that protrudes from the side wall 120. The base portion 172 of the retainer clip 170 overlies a portion of the top wall 132 of the base 130 and thus retains the base portion in the assembled position in the housing 110.

In the assembled condition, the flat flexible cable 150 has a first coiled portion 202 positioned in the annular space 200 between the wall portion 144 of the fold back hoop 140 and the hub 120. The cable has a second coiled portion 204 positioned in the annular space 200 between the wall portion 144 and the side wall 134.

In an assembled condition of the apparatus 10, the rear cover 60, and thus the housing 110, is connected to the steering wheel 14. In this condition, the axis 112 coincides with the steering axis 26 (see FIG. 1). The housing 110 is rotatable with the steering wheel 14 about the steering axis 26 and thus forms a rotor of the rotary connector 100. The base 130 is connectable with a fixed portion of the steering column 16 and thus forms a stator of the rotary connector 100. When the rotary connector 100 is in the assembled condition, the housing 110 (rotor) is rotatable with the steering wheel 14 about the steering axis 26 (and also the axis 112) relative to the base 130 (stator) and the steering column 16.

If the housing 110 is rotated in a clockwise direction with respect to the base 130 as viewed in FIG. 5, the fold back hoop 140 will also rotate in a clockwise direction. The fold back hoop 140 is moved clockwise by winding the flat flexible cable 150 onto the hub portion 120. As the housing 110 rotates in the clockwise direction, the first coiled portion 202 unwinds and passes through the opening 146. If the housing 110 rotates in a counterclockwise direction, the flat flexible cable 150 unwinds from the hub portion 120 and passes through the opening 146, winding in the annular space 200 between the side wall 134 of the base 130 and the wall portion 144 of the fold back hoop 140.

Figure 7:
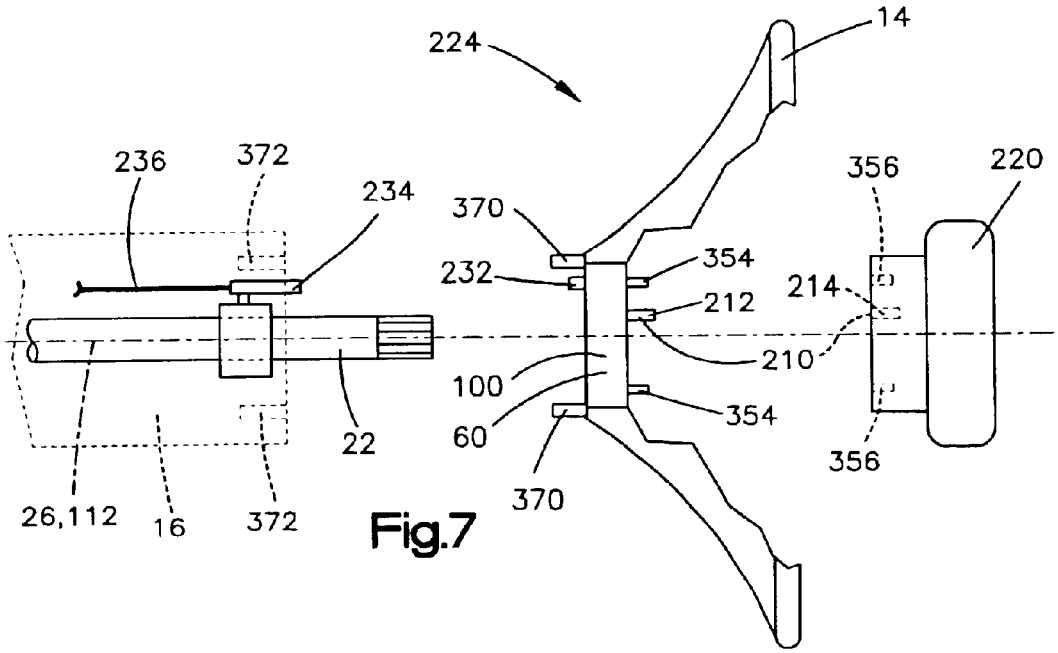
FIG. 7 is a schematic illustration depicting the installation of the apparatus of FIG. 1 in a vehicle.

Referring now to FIGS. 3, 6, and 7, the apparatus includes an up lead connector 210 and a down lead connector 230. The up lead connector 210 is an electrical connector that includes a first connector piece 212 and a second connector piece 214 (see FIG. 7). The first connector piece 212 is molded together with the rear cover 60 and the housing 110 as a single piece of plastic material. The first connector piece 212 extends from a surface of the base wall 112 of the housing opposite the annular space 200. The second connector piece 214 is associated with a steering wheel mounted device 220. The steering wheel mounted device 220 may include the air bag 52 and/or the control switches 56.

The down lead connector 230 is an electrical connector that includes a third connector piece 232 and a fourth connector piece 234 (see FIG. 7). The third connector piece 232 comprises a part of the base 130 and may be molded together with or otherwise connected to the base. The third connector piece 232 extends from a surface of the top wall 132 of the base 130 in a direction opposite the first connector piece 212. The second connector piece 234 is associated with a wiring harness 236 of the vehicle 12 and is fixedly mounted to fixed structure of the vehicle, such as the steering column 16.

Figure 9:
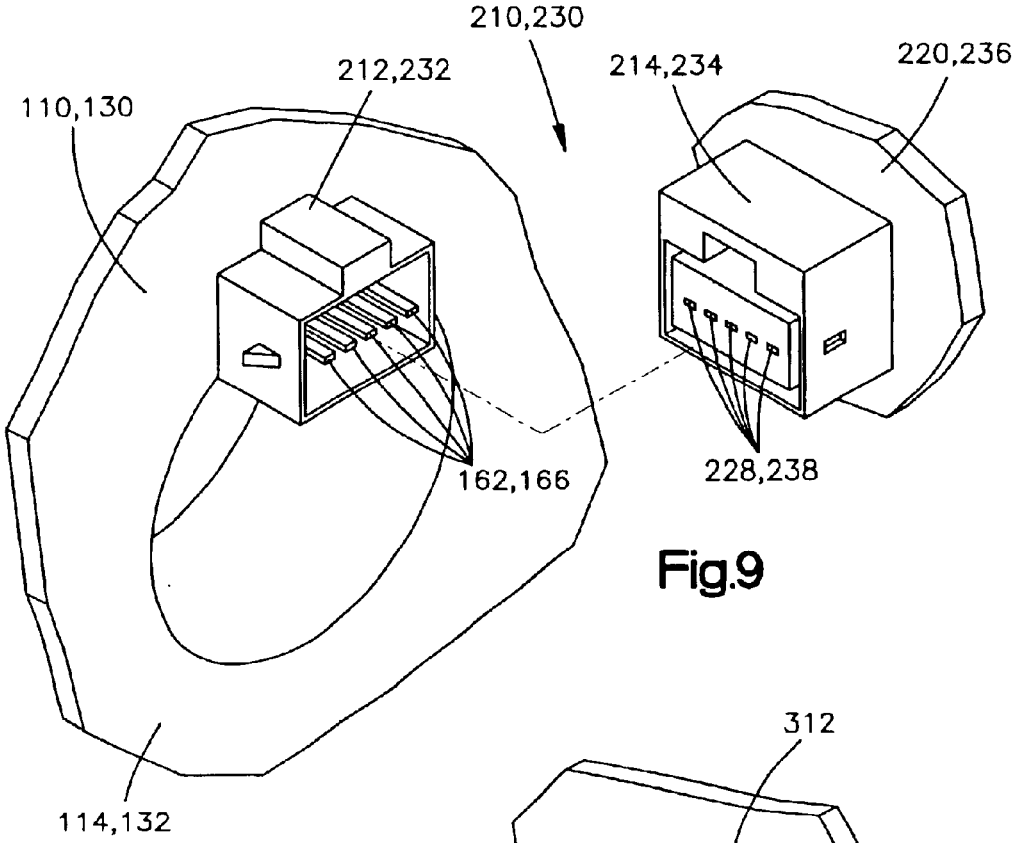
FIGS. 9 and 10 are perspective views illustrating portions of the apparatus of FIG. 1.

FIG. 9 is representative of the general construction that may be used to form both the up lead connector 210 and the down lead connector 230. Referring to FIGS. 6, 7, and 9, the first connector piece 212 is adapted to receive the first end 154 of the flat flexible cable 150 and/or the first terminal assembly 160. The first terminal assembly 160 when assembled with the first connector piece 212 thus forms a portion of the first connector piece. The second connector piece 214 includes terminal receivers 222 that are electrically connected to the steering wheel mounted device 220. The first and second connector pieces 212 and 214 are engageable with each other to electrically connect the terminals 162 with the terminal receivers 222. This provides an electrical connection between the steering wheel mounted device 220 and the flat flexible cable 150.

The third connector piece 232 is adapted to receive the second end 156 of the flat flexible cable 150 and/or the second terminal assembly 164. The third terminal assembly 164 when assembled with the third connector piece 232 thus forms a portion of the third connector piece. The fourth connector piece 234 includes terminal receivers 238 that are electrically connected to the wiring harness 236. The third and fourth connector pieces 232 and 234 are engageable with each other to electrically connect the terminals 166 with the terminal receivers 238. This provides an electrical connection between the wiring harness 236 and the flat flexible cable 150.

According to the present invention, the up lead connector 210 and the down lead connector 230 are docking connectors. By "docking connectors," it is meant that the respective connector pieces of the up lead and down lead connectors 210 and 230 are arranged to connect with each other automatically upon assembly of the structures to which they are connected. In particular, the first and second connector pieces 212 and 214 are adapted to connect with each other automatically when the steering wheel mounted device 220 is assembled with a steering wheel assemblage illustrated at 224 in FIG. 7. The steering wheel assemblage 224 comprises the steering wheel 14, rear cover 30, and rotary connector 100 assembled as a unit. The third and fourth connector pieces 232 and 234 are adapted to connect with each other automatically when the steering wheel assemblage 224 is installed in the vehicle 12, i.e., on the vehicle steering column 16 and/or steering shaft 22.

In each of the up lead and down lead connectors 210 and 230, at least one of the connector pieces is movable in directions transverse to the axis along which the pieces are moved into connection with each other. Regarding the up lead connector 210, at least one of the first and second connector pieces 212 and 214 is movable in directions transverse to the axis along which the first and second connector pieces are moved into connection with each other. Regarding the down lead connector 230, at least one of the third and fourth connector piece 232 and 234 is movable in directions transverse to the axis along which the third and fourth connector pieces are moved into connection with each other. The construction of the up lead and down lead connectors 210 and 230 as docking connectors is illustrated in FIG. 10.

Figure 10:
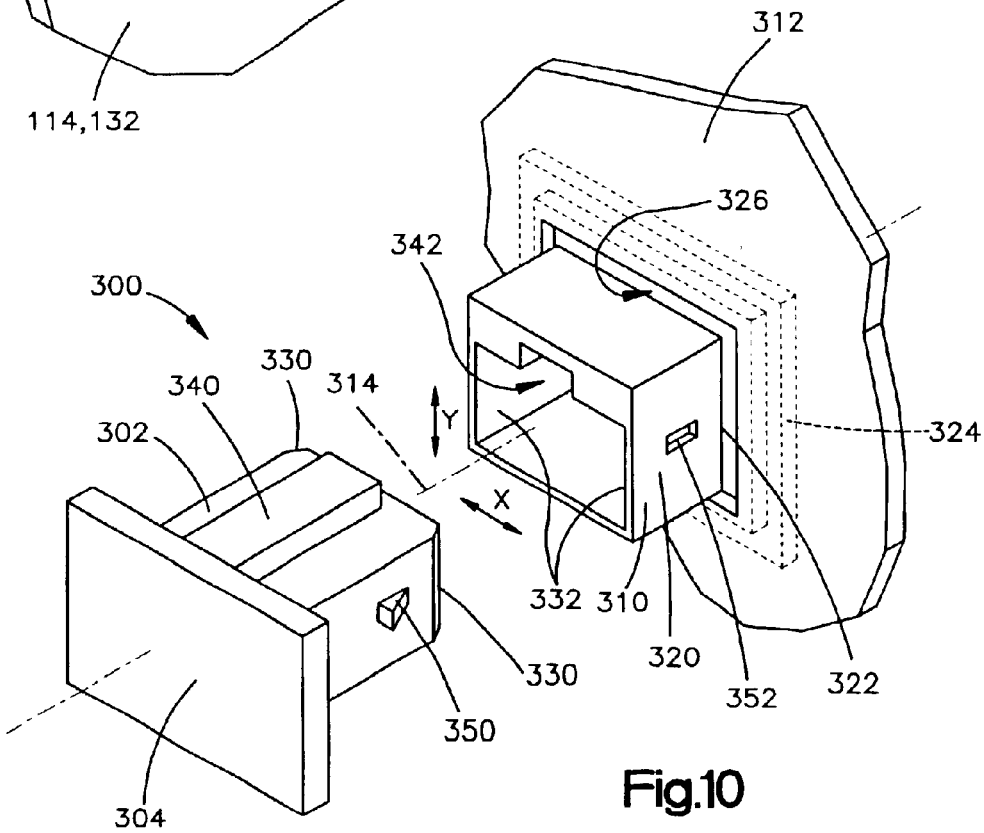

An electrical connector 300 is illustrated schematically in FIG. 10. The connector 300 includes a first connector piece 302 connected to a first part 304 and a second connector piece 310 connected to a second part 312. The first and second connector pieces 302 and 310 are movable in a direction generally along an axis 314 into connection with each other.

The electrical connector 300 may be representative of either the up lead connector 210 or the down lead connector 230. In relation to the up lead connector 210, the first connector piece 302 corresponds to the first connector piece 212 and the second connector piece 310 corresponds to the second connector piece 214. In this relationship, the first part 304 corresponds to the housing 110 and the second part 312 corresponds to the steering wheel mounted device 220. In relation to the down lead connector 230, the first connector piece 302 corresponds to the third connector piece 232 and the second connector piece 310 corresponds to the fourth connector piece 234. In this relationship, the first part 304 corresponds to the base 130 and the second part 312 corresponds to the vehicle wiring harness 236.

Characteristic of the docking connector configuration of the electrical connector 300, the second connector piece 310 is connected to the second part 312 such that the second connector piece can move relative to the second part in directions transverse to the axis 314. These directions are labeled X and Y in FIG. 10. Those skilled in the art will appreciate that this relative movement may be achieved using a variety of constructions.

In the embodiment illustrated in FIG. 10, the second connector piece 310 includes a body portion 320 and a flange portion 322. The flange portion is positioned in a cavity 324 in the second part 312. The body portion 320 protrudes from the second part 312 through an aperture 326 that leads to the cavity 324. The flange portion 322 and the cavity 324 each have a generally rectangular configuration. The dimensions of the cavity 324 are larger than the dimensions of the flange portion 322 in the X and Y directions. This creates a clearance between the cavity 324 and the flange portion 322 which permits movement of the flange portion, and thus the second connector piece 310, in the X and Y directions relative to the axis 314 and the second part 312.

The first and second connector pieces 302 and 310 may include features that help guide the pieces relative to each other while connecting the pieces. The first connector piece 302 includes beveled surfaces 330 that may engage side walls 332 of the second connector piece 310 while moving the pieces towards each other. Engagement between the beveled surfaces 330 and the side walls 332 may cause the second connector piece 310 to move in the X and/or Y directions relative to the second part 312, thus causing the first and second connector pieces to align with each other.

The first connector piece 302 may also include a key 340 that cooperates with a key way 342 in the second connector piece 310 to help align the first and second connector pieces and to help ensure that the pieces are in a proper orientation relative to each other when connected. The first connector piece 302 may also include means such as a latch 350 that cooperates with an aperture 352 in the second connector piece 310 to help retain the first and second connector pieces in a connected condition.

Referring to FIG. 7, when the steering wheel mounted device 220 is assembled or installed on the steering wheel assemblage 224 (i.e., the steering wheel 14, rear cover 30, and rotary connector 100 assembled as a unit), the steering wheel mounted device is electrically connected with the flat flexible cable of the rotary connector 100 automatically via the docking connector feature of the first and second connector pieces 212 and 214 of the first electrical connector 210. This may be done either before or after the steering wheel assemblage 224 is installed on the steering column 16 and steering shaft 22.

The apparatus 10 may also include means for helping to ensure proper alignment between the steering wheel assemblage 224 and the steering wheel mounted device 220. For example, as shown in FIGS. 6 and 7, the apparatus 10 may include one or more clips 354 that projects from the base wall 114 of the housing 110 in the same general direction as the first connector piece 212. The clips 354 may be formed as a single piece of plastic material with the rear cover 30, housing 110, and first connector piece 212. The clips 354 may cooperate with receivers 356 in the steering wheel mounted device 220. The clips 354 and the receivers 356 cooperate to guide the steering wheel mounted device 220 to the proper position relative to the steering wheel assemblage 224. The clips 354 and receivers 356 may also cooperate to help connect the steering wheel mounted device 220 to the steering wheel assemblage 224.

Referring to FIG. 7, when the steering wheel assemblage 224 is mounted on the steering column 16 and steering shaft 22, the flat flexible cable 150 is electrically connected with the wiring harness 236 automatically via the docking connector feature of the third and fourth connector pieces 232 and 234 of the second electrical connector 230. This may be done either before or after the steering wheel mounted device 220 is installed on the steering wheel assemblage 224.

The apparatus 10 may also include means for helping to ensure proper alignment between the steering wheel 14 and the steering shaft 22 and between the rotary connector 100 and the steering column 16. For example, as shown in FIGS. 3–5, the apparatus 10 may include a key 360 that projects into the aperture 124 from the side wall 122 of the hub portion 120 of the housing 110. The key 360 may cooperate with a key way 362 in the steering shaft 22 such that the housing 110, and thus the rotary connector 100, are properly aligned when assembled. The key way 362 may also cooperate with a key (not shown) in the hub portion 30 of the steering wheel 14 to help ensure proper alignment between the steering wheel and the steering shaft 22.

The apparatus 10 of the present invention, when installed in the vehicle 12, helps provide an electrical connection from the steering wheel mounted devices 220 to the vehicle wiring harness 236. Advantageously, the first and second electrical connectors 210 and 230, being docking connectors, allow their respective electrical connections to be established automatically while installing the steering wheel assemblage 224 and the steering wheel mounted devices 220. This may help eliminate installation steps and simplify the installation process. As a further advantage, construction of the rear cover 30, housing 110, first connector piece 212, and clips 354 as a single piece of plastic material may help reduce the number of parts included in the apparatus 10, may help simplify manufacturing of the apparatus, and may help reduce the design complexity of the apparatus.

From the above description of the invention, those skilled in the art will perceive improvements, changes and modifications in the invention. Such improvements, changes and modifications within the skill of the art are intended to be covered by the appended claims.

What is claimed is:

1. Apparatus comprising:

a vehicle steering wheel;

a device having an electrical connection, said device being mountable at a predetermined position on said steering wheel;

a rear cover for at least partially covering said steering wheel, said rear cover being connected to said steering wheel; and a rotary connector for providing an electrical connection with said device, said rotary connector comprising:

a housing formed as an integral part of said rear cover;

a base connected to said housing, said housing and said base being rotatable relative to each other about an axis;

a cable coiled in an annular space defined by said housing and said base;

a first electrical connector comprising a first connector piece including portions electrically connected to a first end of said cable and a second connector piece including portions electrically connected to said device, said housing, said rear cover, and portions of said first connector piece being a single piece of plastic material; and first guide means for guiding said device toward said predetermined position on said steering wheel, said second connector piece being guided to interconnect with said first connector piece when said device is guided to said predetermined position by said first guide means, said first and second connector pieces when interconnected providing an electrical connection between said device and said cable.

2. Apparatus as recited in claim 1, further comprising a second electrical connector comprising a third connector piece including portions electrically connected to a second end of said cable and a fourth connector piece electrically connected to a vehicle wiring harness and mounted on the steering column, portions of said third connector piece and said base being a single piece of plastic material.

3. Apparatus as recited in claim 2, further comprising second guide means for guiding an assemblage comprising said steering wheel, said rear cover, and said rotary connector toward a predetermined installed position in the vehicle, said third connector piece on said base being guided to interconnect with said fourth connector piece on the steering column when said assemblage is guided to said installed position in the vehicle, said third and fourth connector pieces when interconnected providing an electrical connection between a wiring harness of the vehicle and said cable.

4. Apparatus as recited in claim 3, wherein said base is connectable to a fixed portion of a vehicle steering column and said steering wheel is connectable to a steering shaft of the vehicle, said rear cover and said housing being rotatable with said steering wheel and said steering shaft about said axis relative to said base and said steering column.

5. Apparatus as recited in claim 4, wherein said rotary connector includes a central passage through which said steering shaft extends when said assemblage is installed in the vehicle, said central passage having a generally cylindrical configuration extending coaxially with said axis, said central passage extending through said base and said housing.

6. Apparatus as recited in claim 1, wherein said rear cover further comprises at least one assembly clip that cooperates with a receiving portion of said steering wheel to help connect said rear cover to said steering wheel, said rear cover, said housing, said first electrical connector, and said at least one assembly clip being a single piece of plastic material.

7. Apparatus comprising:

a vehicle steering wheel;

a device having an electrical connection, said device being mountable at a predetermined position on said steering wheel;

a rear cover for at least partially covering said steering wheel, said rear cover being connected to said steering wheel; and a rotary connector for providing an electrical connection with said device, said rotary connector comprising:

a housing formed as an integral part of said rear cover;

a base connected to said housing, said housing and said base being rotatable relative to each other about an axis;

a cable coiled in an annular space defined by said housing and said base;

a first electrical connector comprising a first connector piece including portions electrically connected to a first end of said cable and a second connector piece including portions electrically connected to said device, said housing, said rear cover, and portions of said first connector piece being a single piece of plastic material; and first guide means for guiding said device toward said predetermined position on said steering wheel, said second connector piece being guided to interconnect with said first connector piece when said device is guided to said predetermined position by said first guide means, said first and second connector pieces when interconnected providing an electrical connection between said device and said cable;

wherein said housing comprises a base wall extending axially from said axis and a cylindrical side wall extending perpendicularly from a periphery of said base wall, said housing further comprising a cylindrical hub portion centered on said axis and extending perpendicularly from said base wall, said base when connected to said housing being spaced from said base wall and extending from said hub portion to said side wall, said annular space being defined by said base wall, said side wall, said hub portion, and said base, said rotary connector further comprising a spacer positioned in said annular space, said cable having a first portion positioned in said annular space between said spacer and said hub portion and a second portion positioned in said annular space between said spacer and said side wall, said first portion being coiled in a first direction, said second portion being coiled in a second direction opposite said first direction.

8. Apparatus as recited in claim 1, wherein said device comprises at least one of an airbag module, audio system control switches, climate control switches, cruise control switches, communication device control switches, and horn switches.

9. Apparatus as recited in claim 1, wherein said rear cover forms a class A surface in the vehicle.

10. Apparatus as recited in claim 1, wherein said first connector piece further comprises at least one terminal electrically connected with said cable and said second connector piece further comprises at least one receiver for receiving said at least one terminal and providing an electrical connection with said at least one terminal, said at least one receiver being electrically connected to said device.

11. Apparatus as recited in claim 1, wherein said second connector piece is connected to said device so as to be movable in transverse directions relative to an assembly axis along which said first and second connector pieces are moved into connection with each other, said first and second connector pieces having surfaces engageable with each other to cause movement of said second connector piece in said transverse directions while moving said first and second connector pieces along said assembly axis.

12. Apparatus comprising:

a vehicle steering wheel;

a device having an electrical connection, said device being mountable at a predetermined position on said steering wheel;

a rear cover for at least partially covering said steering wheel, said rear cover being connected to said steering wheel; and a rotary connector for providing an electrical connection with said device, said rotary connector comprising:

a housing formed as an integral part of said rear cover;

a base connected to said housing, said housing and said base being rotatable relative to each other about an axis;

a cable coiled in an annular space defined by said housing and said base;

a first electrical connector comprising a first connector piece including portions electrically connected to a first end of said cable and a second connector piece including portions electrically connected to said device, said housing, said rear cover, and portions of said first connector piece being a single piece of plastic material;

first guide means for guiding said device toward said predetermined position on said steering wheel, said second connector piece being guided to interconnect with said first connector piece when said device is guided to said predetermined position by said first guide means, said first and second connector pieces when interconnected providing an electrical connection between said device and said cable; and a second electrical connector comprising a third connector piece including portions electrically connected to a second end of said cable and a fourth connector piece electrically connected to a vehicle wiring harness and mounted on the steering column, portions of said third connector piece and said base being a single piece of plastic material;

wherein said third connector piece further comprises at least one terminal electrically connected with said cable and said fourth connector piece further comprises at least one receiver for receiving said at least one terminal and providing an electrical connection with said at least one terminal, said at least one receiver being electrically connected to the vehicle wiring harness.

13. Apparatus comprising:

a vehicle steering wheel;

a device having an electrical connection, said device being mountable at a predetermined position on said steering wheel;

a rear cover for at least partially covering said steering wheel, said rear cover being connected to said steering wheel; and a rotary connector for providing an electrical connection with said device, said rotary connector comprising:

a housing formed as an integral part of said rear cover;

a base connected to said housing, said housing and said base being rotatable relative to each other about an axis;

a cable coiled in an annular space defined by said housing and said base;

a first electrical connector comprising a first connector piece including portions electrically connected to a first end of said cable and a second connector piece including portions electrically connected to said device, said housing, said rear cover, and portions of said first connector piece being a single piece of plastic material;

first guide means for guiding said device toward said predetermined position on said steering wheel, said second connector piece being guided to interconnect with said first connector piece when said device is guided to said predetermined position by said first guide means, said first and second connector pieces when interconnected providing an electrical connection between said device and said cable; and a second electrical connector comprising a third connector piece including portions electrically connected to a second end of said cable and a fourth connector piece electrically connected to a vehicle wiring harness and mounted on the steering column, portions of said third connector piece and said base being a single piece of plastic material;

wherein said fourth connector piece is connected to the vehicle steering column so as to be movable in transverse directions relative to an assembly axis along which said third and fourth connector pieces are moved into connection with each other, said third and fourth connector pieces having surfaces engageable with each other to cause movement of said fourth connector piece in said transverse directions while moving said third and fourth connector pieces along said assembly axis.

14. A rotary connector for providing an electrical connection from a steering column of a vehicle to a components mounted on a steering wheel rotatable relative to the steering column, said rotary connector comprising:

a rear cover connectable to the steering wheel to at least partially cover a hub of the steering wheel, said rear cover including a portion comprising a housing of said rotary connector;

a base connected to said housing, said housing and said base being rotatable relative to each other about an axis;

a cable coiled in an annular space defined by said housing and said base;

a first electrical connector comprising a first connector piece electrically connected to a first end of said cable and a second connector piece electrically connected to said electrical device, said housing, said rear cover, and portions of said first connector piece being a single piece of plastic material; and first guide means for guiding said electrical device toward a predetermined position on the steering wheel while mounting said electrical device on the steering wheel, said second connector piece being guided to interconnect with said first connector piece when said electrical device is guided to said predetermined position by said first guide means, said first and second connector pieces when interconnected providing an electrical connection between said electrical device and said cable.

* * * * *